United States Patent [19]

Meyer

[11] 3,961,595

[45] June 8, 1976

[54] STEERING APPARATUS FOR SMALL OUTBOARD MOTORS

[75] Inventor: James A. Meyer, Oshkosh, Wis.

[73] Assignee: Brunswick Corporation, Skokie, Ill.

[22] Filed: Aug. 29, 1974

[21] Appl. No.: 501,486

[52] U.S. Cl. ..... 115/18 R
[51] Int. Cl.[2] ..... B63H 21/26
[58] Field of Search ..... 115/18 R, 17, 35; 64/14

[56] References Cited

UNITED STATES PATENTS

| | | | |
|---|---|---|---|
| 1,417,432 | 5/1922 | Walker | 64/14 |
| 1,932,785 | 10/1933 | Irgens | 115/18 R |
| 2,100,559 | 11/1937 | Irgens | 115/18 R |
| 2,560,644 | 7/1951 | Hartzell | 64/14 |
| 2,601,396 | 6/1952 | Henry | 115/17 |
| 2,644,419 | 7/1953 | Heindner et al. | 115/18 R |
| 2,735,396 | 2/1956 | Agar | 115/17 |

*Primary Examiner*—Duane A. Reger
*Assistant Examiner*—Gregory W. O'Connor
*Attorney, Agent, or Firm*—Andrus, Sceales, Starke & Sawall

[57] ABSTRACT

An outboard motor has a steering tiller handle assembly attached to the driveshaft housing and pivotally mounted within a swivel mounting bracket assembly. The swivel bracket assembly includes a split tubular element within which a split tubular section of the steering arm assembly is notably mounted and located encircling a tubular portion of the driveshaft housing. Upper and lower annular rubber mounts are located between the upper and lower end of the steering tubular section and the driveshaft housing. Each mount is formed with a first pair of axial slots formed in diametrically opposite sides of the mount and projecting inwardly from one end. A similar pair of slots offset by 90° from the first set of slots extending inwardly from the opposite end of the annular amount. The driveshaft housing and the steering tubular section are provided with correspondingly offset projections adapted to mate with the slots in the annular mounting. Upper and lower sleeve bearings are located between the tubular section of the swivel bracket assembly and the steering arm assembly. The driveshaft housing is also employed as the exhaust passageway and includes a pair of openings aligned with the chamber to the steering assembly, the aft portion of which opens to the tubular section of the swivel bracket assembly. The outer wall of the swivel tubular section is provided with a generally U-shaped passageway with a closed end aligned with an exhaust opening and extending upwardly and then downwardly to discharge exhaust gases downwardly toward the water.

18 Claims, 9 Drawing Figures

STEERING APPARATUS FOR SMALL OUTBOARD MOTORS

BACKGROUND OF THE INVENTION

The present invention relates to a steering apparatus for outboard motors and particularly to manually operated tiller-type steering apparatus coupled directly to the outboard motor unit.

Outboard motors and particularly relatively low horsepower motors are constructed with a steering assembly which the operator manipulates from the rear of the boat. Generally a steering handle assembly is attached directly to the upper powerhead or drive shaft housing which, in turn, is pivotally mounted within a suitable swivel mounting bracket. The vibration of the outboard motor and particularly the powerhead is transmitted to the manually grasped end of twist handle. This has been generally accepted with the effects of vibration minimized by the use of relatively soft rubber grips. Such vibration is also transmitted to the boat transom. Special isolation mounting systems have been suggested but are generally employed in the larger and more expensive engines.

SUMMARY OF THE PRESENT INVENTION

The present invention is particularly directed to a isolated mounting means for a manually operated steering unit, and in particular, provides a unitary vibration isolation coupling of the powerhead to the steering assembly and the swivel bracket assembly to minimize the transmission of vibrations from the powerhead. Generally, in accordance with the teaching of the present invention, the powerhead drive shaft housing is rotatably supported within axially spaced resilient mounts which are coupled respectively to the drive shaft housing and to a tubular steering unit rotatively mounted within a swivel bracket means. The steering unit is connected to a steering handle means. The resilient mounts are formed of a rubber-like material of a sufficient stiffness to transmit rotating motion of the steering arm and unit to the drive shaft housing for steering of the outboard motor while effectively isolating the powerhead and drive shaft housing from the steering mechanism and the supporting swivel bracket means.

More particularly, in accordance with a preferred and novel construction of the present invention, the swivel bracket includes a split tubular element within the steering arm pivot support and drive shaft housing are assembled. The split unit permits convenient assembly of the various components. The steering arm assembly includes a steering arm unit having a pivot support with upper and lower coupling bearing members with the upper member having an interconnected, outwardly extending steering arm. The upper and lower connecting bearing units are also formed as split members with the outer portion defined by a pair of separate spaced clamping cup or cover members. The drive shaft housing is formed with a generally tubular extension of a length generally corresponding to the length of the steering arm pivot support. The steering arm support is clamped about the drive shaft housing with an upper and lower annular mount located between the steering bearing units and the corresponding portions of the drive shaft housing, with mounts coupled to the housing and bearing units by complementing, mating slots and projections.

In a preferred construction, the annular rubber mounts are formed with a first pair of axial slots formed in diametrically opposite sides of the mount and projecting inwardly from one end. A similar pair of slots offset by 90° from the first set of slots and extending inwardly from the opposite end of the annular mount. The drive shaft housing and the arm bearing are provided with correspondingly offset projections adapted to mate with the slots in the annular mounts.

The assembly is clamped within a split tubular member of the swivel bracket assembly with upper and lower sleeve type bearings located between the steering bearings and the swivel bracket tubular members. The sleeve bearings are preferably formed with outwardly projecting flanges providing thrust bearings between the ends of the tubular unit of the swivel bracket and the steering arm bearings. A clamping co-pilot band may be located about the upper sleeve bearing unit to permit adjustable clamping pressure on the upper bearing unit for holding of the motor in any given position.

Further, in accordance with a further aspect of the present invention, the drive shaft housing is employed as the exhaust passageway for discharging of the exhaust gases outwardly through the lower unit. Under idle conditions, the lower end of the exhaust tube may be essentially closed off and an idle relief passage is preferably provided to permit escape of the exhaust gases. In accordance with a further teaching of the present invention, the drive shaft housing is provided with an opening permitting the exhaust gases to pass outwardly through the chamber between the steering support member and the outer or aft wall of swivel bracket assembly. An opening is provided in the aft wall to allow the exhaust gases to pass into a tuning passageway for discharge to the atmosphere. In accordance with a further novel aspect of the present invention, the outer swivel wall is provided with a generally U-shaped passageway with a closed end aligned with the exhaust opening and extending upwardly and then downwardly to discharge exhaust gases downwardly toward the water. The combination of the internal expansion and baffle chambers provided by the concentric steering support and the drive shaft housing assembly with the extended tuning passageway permits significant tuning of the exhaust system at idle to thereby minimize the sound of the exhaust gases. In particular, the volume of the chamber and the length and cross section of the tuning passageway are selected to provide a tuned characteristic generally similar to that described in the co-pending application of Joseph H. Harralson et al. entitled "Exhaust Relief Silencing Apparatus for Marine Propulsion Systems" filed on Aug. 26, 1974 with Ser. No. 500,634 and assigned to the assignee of this application.

The present invention has been found to provide a highly improved isolated steering assembly significantly minimizing the vibration transmission from the powerhead unit to the steering assembly.

BRIEF DESCRIPTION OF THE DRAWINGS

The accompanying drawings illustrate the best mode presently comtemplated by the inventor for carrying out the invention.

In the drawings.

DESCRIPTION OF THE PREFERRED EMBODIMENT

Figure 1:
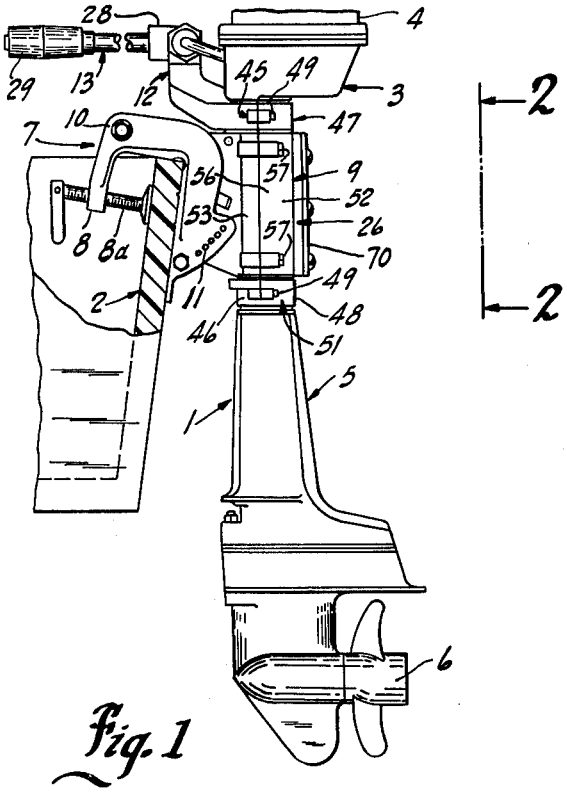
FIG. 1 is a side elevational view of a outboard motor unit constructed in accordance with the teaching of the present invention.
Figure 2:
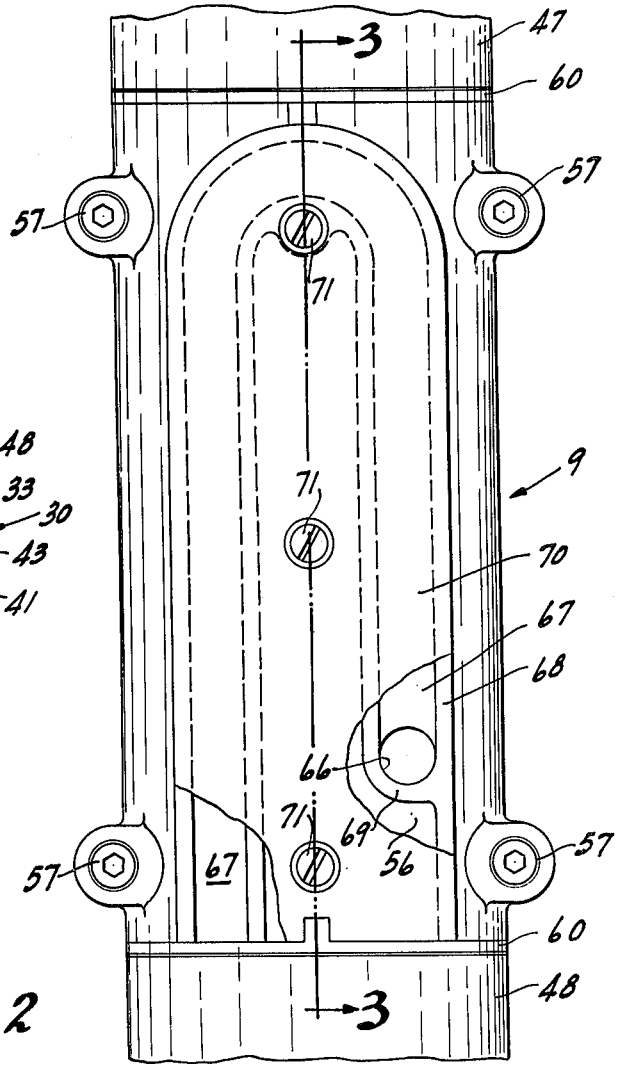
FIG. 2 is a fragmentary rear elevational view of the outboard motor unit shown in FIG. 1.

Referring to the drawings and particularly to FIGS. 1 and 2, an outboard motor 1 is secured to the transom 2 of a boat. The outboard motor 1 generally includes an upper powerhead 3 within which an internal combustion engine 4 is located as a prime mover. The powerhead 3 is supported upon the upper end of a drive shaft housing 5 terminating at the lower end in propeller unit 6. The outboard motor 1 is coupled to the transom 2 by a swivel bracket assembly 7 having a generally U-shaped fixed clamping bracket 8 which is clamped to the transom 2 through the usual bolt unit 8*a*. A mounting and steering coupling assembly 9, which is particularly constructed in accordance with the teaching of the present invention, is secured to the upper portion of the drive shaft housing 5 adjacent to the powerhead 3 and is pivotally interconnected to the bracket 8 as at 10. This permits pivotal movement about a horizontal axis for conventional orientation of the outboard motor 1 with respect to the boat transom. A conventional pin and slot lock assembly 11 is also provided for locking of the outboard motor 1 in the desired angular orientation. The assembly 9 generally swivelly mounts the drive shaft housing 5 to the bracket assembly 7 and includes an upper manually operated arm bracket 12 extending outwardly to a tiller handle 13 for manually pivoting of the outboard motor unit 1 about a generally vertical axis for purposes of steering.

In accordance with the present invention, the tiller handle 13 and interconnected arm bracket 12 are coupled to the power unit of outboard motor 1 through the unique mounting and coupling section 9. The preferred construction is shown in detail in FIGS. 3–7. The other components of the outboard motor may be constructed with any known or desired design and structure, no further description thereof is given other than is required to clearly describe the illustrated embodiment of the present invention.

Figure 3:
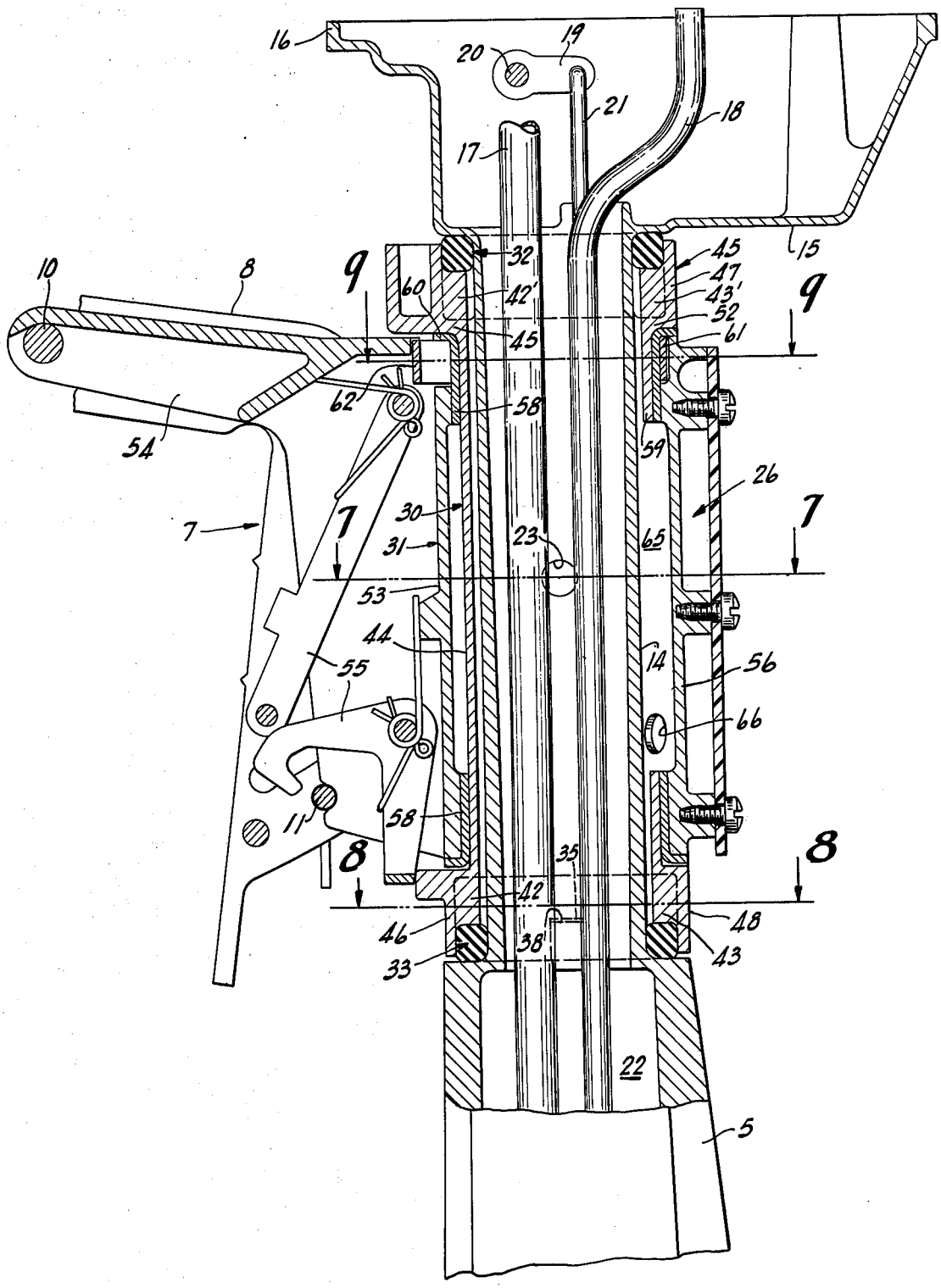
FIG. 3 is an enlarged vertical section taken generally on line 3—3 of FIG. 2 through the upper portion of the outboard motor unit including the swivel bracket assmebly.
Figure 5:
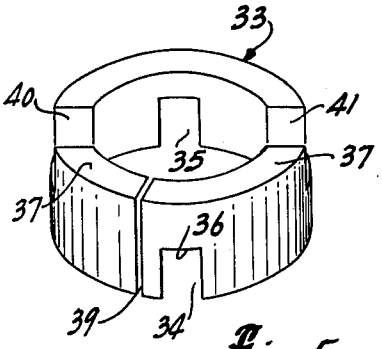
FIG. 5 is a pictorial view of the annular resilient mount shown in FIGS. 1–3.
Figure 6:
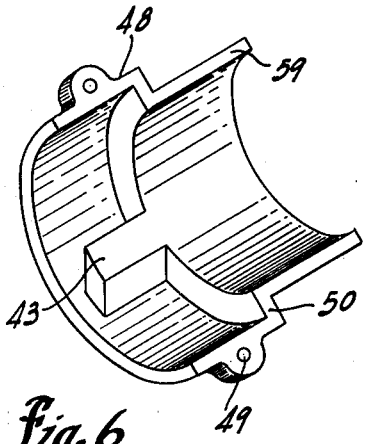
FIG. 6 is a pictorial view of a clamping cover member of the tuning assembly.

Referring particularly to FIG. 3, the drive shaft housing 5 in the illustrated embodiment of the invention is shown constructed with upper cylinder 14 extending downwardly from an upper cup-shaped powerhead support section 15. The upper end of the cup-shaped housing section 15 is provided with a suitable mounting flange 16 to which the engine 4 is suitably secured. The engine includes a drive shaft 17, which projects downwardly through the drive shaft housing 5 including the upper section 15, the cylinder portion 14 and the lower portion to lower propeller unit 6 where it is suitably connected to drive the propeller unit 6. A water cooling tube 18 also extends through the drive shaft housing 5 to provide cooling water to the engine 4 with the water discharging downwardly through the drive shaft housing in accordance with conventional practice. Additionally, in a reversible motor construction, a shift lever 19 is pivotally mounted within the side wall of the upper section of the cup-shaped section 15 and coupled externally to a shift lever and shaft 20. The shift arm or shaft 20 extends through the drive shaft housing 5 and interconnects the shift lever to the propeller unit 6 for effecting forward or reversed rotation in response to engine operation. In addition, the drive shaft housing 5 defines an exhaust chamber 22 extending downwardly to the lower end of the unit 6 where the exhaust gases of the engine 4 are discharged, preferably through the propeller unit 6 in accordance with any known or desired construction. During engine idle operation, exhaust gases may be trapped within chamber 22. The drive shaft housing 5 is provided with a pair of aligned openings 23 and 24 generally centrally of the length of the cylinder 14 to permit discharge of exhaust gases therefrom under idle conditions. The exhaust gases passed outwardly of the section 14 and through a generally tortuous assembly path within the section 9 and particularly through an idle exhaust tuning section 26 secured to the aft or back side of the assembly 9, as more fully developed hereinafter to reduce the noise level under idle conditions.

The cylinder 14 of the drive shaft housing 5 is coupled through the assembly 9 to the tiller handle 13 which is pivotally connected to the arm 12 by a suitable pivot connection 28. A throttle control twist grip 29 of a suitable, soft rubber is rotatably mounted on the outer end of handle 13 with a coupling means, not shown, extended through the handle to the engine throttle control. A particularly satisfactory handle construction is shown in applicant's copending application entitled, "STEERING APPARATUS FOR OUTBOARD MOTORS" and filed on Aug. 29, 1974 with Ser. No. 501,498 and assigned to the same assignee. The pivotal connection permits the folding of the handle 13 to a convenient storage position as well as rotation outwardly to a generally horizontal steering position which permits the convenient pivoting of the outboard motor 1 about the vertical axes of the drive shaft housing cylinder 14. The steering assembly or handle 13 and particularly arm 12 are especially constructed as a part of assembly 9 to minimize transmission of the vibration inherent in the operation of an internal combustion engine 4 to the operator and to the boat.

Referring particularly to FIG. 3, the illustrated embodiment of the assembly 9 includes a generally tubular steering arm section 30 encircling the shaft housing cylinder 14 within a tubular support section 31 of the bracket assembly or unit 7. The steering arm tubular section 30 is coupled at the upper and lower ends to the drive shaft housing cylinder 14 by special resilient mounts 32 and 33 to provide for transmission of the rotating forces from the steering arm assembly to the drive shaft housing 5 and thus to the outboard motor 1 while maintaining vibration isolation therebetween.

As each of the mounts 32 and 33 is similarly constructed, the lower mount 33 is described in detail with the corresponding elements of the upper mount 32 identified by corresponding primed numbers. Referring particularly to FIGS. 3–5, and 8, the resilient mount 33 is shown as an annular rubber element having an inner diameter essentially corresponding to that of the outer diameter of the cylinder 14. The outer diameter of mount 33 essentially corresponds to the inner diameter of the steering tubular section 30. The resilient mount 33 is provided with a first pair of diametrically located end slots 34 and 35 which in the lower unit 33 extend upwardly from the bottom most wall or edge and terminate in a base 36 in a spaced relation to the uppermost end 37 of the annular member. The illustrated housing 5 is a cast member having a pair of projections corresponding essentially to the slots or recesses 34 and 35 integrally formed on diametrically opposite sides of the lower end of cylinder 14. The mount 33 is split as at 39 to permit assembly of mount 33 about the cylinder 14 with the slots 34 and 35 mating with the projections of 38.

At 90° and thus normal to the plane of slots 34 and 35, a similar pair of slots 40 and 41 are formed in the upper edge or wall 37 of the mount 33.

The tubular section 30 is provided with a pair of similar projections 42 and 43 in diametrically opposed relation for mating with the slots 40 and 41. The tubular section 30, as presently described, is formed as a split unit to allow assembly about the mounts 32 and 33.

The mounts 32 and 33 are formed of a suitable rubber or other resilient material which provides excellent vibrational isolation between the drive shaft housing 5 and the tubular section 30 of the steering arm assembly. The stiffness of the mounts 32 and 33, however, is selected to provide essentially direct transfer of the rotating forces from the steering arm assembly 13 and particularly the tubular section 30 to the cylinder 14 and therefore to the drive shaft housing 5 and the interconnected upper powerhead 3 and the lower propeller unit 6.

The steering tubular section 30 includes an inner semi-circular cylindrical base 44 terminating in the upper and lower ends in enlarged coupling bearing portions 45 and 46 within which the coupling projections 42 and 42′ are formed. The upper portion 45 has the steering arm 12 integrally formed therewith. Upper and lower semi-circular bearing covers 47 and 48 are similarly interconnected to the portions 45 and 46 by interconnecting bolt units 49 to the diametrically opposite sides of the section 30. The sections 47 and 48 define the split construction permitting the assembly thereof to the mounts 32 and 33.

The lower bearing portion 46 and associated cover 48 are formed with inset tubular portions defining a horizontal base 50 which rests on the upper wall 37 of the mount 33 to vertically support the tubular section 30. The mount 33 in turn rests on cast ledge 51 formed by an enlarged lower formed wall of housing 5.

The upper bearing portion 45 and associated cover 47 are similarly formed with the inset tubular portion extending downwardly and defining a support ledge 52 on which mount 32 rests. The underside of the housing section 15 rests on the mount 32 and thus supports the assembly on the upper bearing unit, which as presently described is supported by the tubular section 31 of the swivel bracket assembly as described hereinafter.

The outboard motor 1 is thereby supported by the annular rubber mounts 32 and 33 within the tubular section 30 which is rotatedly mounted within the swivel bracket section 31 as follows.

Referring particularly to FIGS. 1, 3, 8 and 9, the tubular section 31 includes a generally semi-circular base 53 to which a mounting arm unit 54 is integrally connected or cast. The arm section 54 projects outwardly and is pivoted to the fixed bracket 8 as at the pivot point 10. Suitable spring loaded levers 55 act between the section 54 and the fixed bracket 8 to pivot the total assembly in accordance with the limit permitted by the locking assembly 11. Any other suitable interconnecting pivotal support assembly can, of course, be provided, and no further description thereof is given herein.

The tubular section 31 is completed by an outer semi-circular cover 56 which is bolted to the base 53 by longitudinally spaced interconnecting bolt units 57 to the opposite sides of the tubular section 31. The tubular section 31, as defined by members 53 and 56, defines a tubular section of a slightly shorter length than that of section 30 and of a somewhat greater internal diameter. The section 30 is supported within section 31 by similar upper and lower sleeve bearings 58.

The upper sleeve bearing 58 is located between the reduced inset portion 59 of the bearing 45 and cover 47 and the adjacent encircling tubular section 31 which is slightly enlarged to form a suitable bearing surface. The bearing 58 includes an upper thrust flange 60 extended outwardly beneath ledge 52 and supporting the upper bearing portion 45–47 of the steering tubular section 30 on the upper end of section 31. The lower bearing 58 is similarly formed with its flange 60 located to the lower end of the section 31 and resting on ledge 50 of cover 48 to provide a thrust bearing support of the lower end of tubular section 31 on the adjacent end of tubular section 30.

Figure 9:
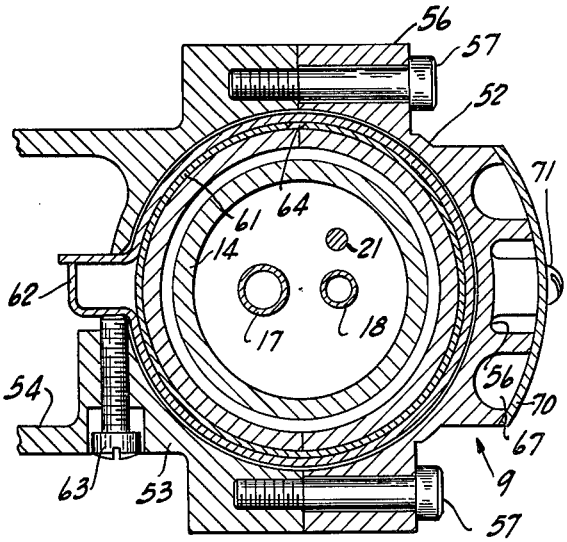
FIG. 9 is a horizontal section taken generally on line 9—9 of FIG. 3.
Figure 8:
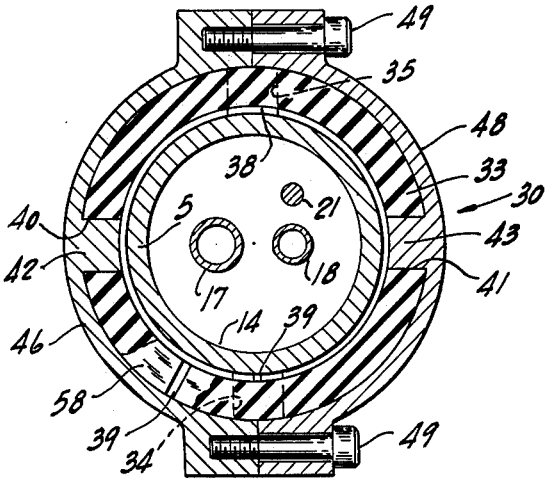
FIG. 8 is a horizontal section taken generally on line 8—8 of FIG. 3.

In addition, as most clearly shown in FIGS. 3 and 9, a "co-pilot" tension strap 61 encircles the bearing 58 with the end adjacent to the arm 54 offset as at 62 to define an encircling spring member. A clamp bolt 63 threads through the upper arm portion of the arm 54 and bears against the spring section 62 to adjust the clamping force of the strap 61 on the bearing 57. The bearing, in turn, is split as at 64, as shown in FIG. 9, such that the spring force tends to collapse the bearing onto the tubular section 30 of the steering arm assembly and thereby varies the friction holding force. If as a result of wear or the like, the steering assembly should tend to move as a result of vibrations or accidental bumping or the like, the holding force can be increased by merely tightening of the co-pilot bolt 63 in accordance with more or less conventional constructions.

In summary, the exhaust housing 5 is rotatably mounted within the special mounting and coupling assembly 9 with the special resilient mounts 32 and 33 isolating the steering tubular section 30 and the bracket tubular section 31 from the engine vibration and thereby minimizes vibration at the tiller handle 29 and the boat 2.

Figure 7:
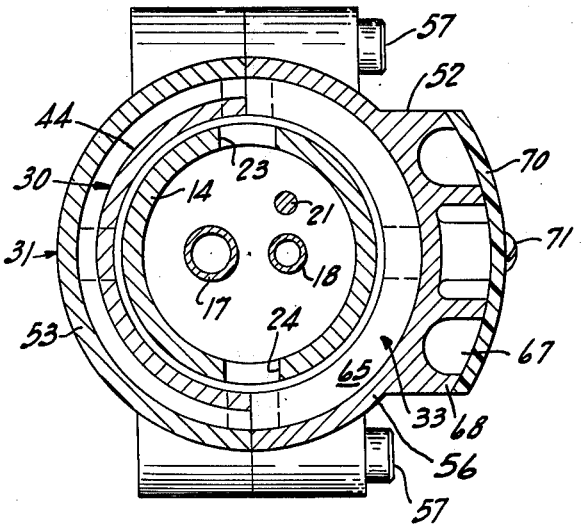
FIG. 7 is a horizontal section taken generally on line 7—7 of FIG. 3.
Figure 4:
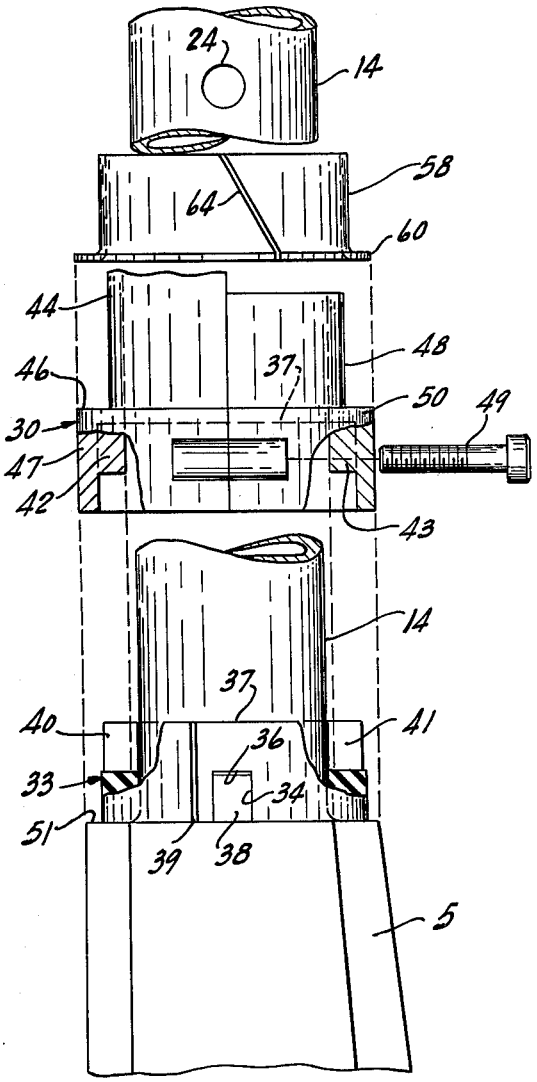
FIG. 4 is a fragmentary exploded view illustrating a portion of the bracket and steering assembly mounting shown in FIGS. 1–3.

As previously noted, the exhaust housing cylinder tube 14 also functions as the exhaust tube and is provided with special idle exhaust openings 23 and 24. The exhaust gases thus are discharged laterally from the exhaust tube under idle conditions into the chamber 65 between the semi-circular base 44 of the steering arm tubular section 30 and pass about the cylinder 14 to the rear, as viewed in FIGS. 3 and 7. The bearing covers 47 and 48 are of course spaced and the chamber extends to the outer bracket cover 56 which is provided with an exhaust opening 66 in the lower end immediately above the sleeve bearing assembly. The gases pass into the tuning section 26. Referring particularly to FIGS. 2, 3 and 7, a generally inverted, U-shaped exhaust passageway 67 is formed with integrally cast sidewalls 68 projecting outwardly from the cover 56. The U-shaped passageway 56 is provided with a closed wall end 69 aligned with the opening 66 and extends upwardly to the upper end portion of the bracket portion cover 56 and then downwardly completely throughout the length of the opposite side of the cover to discharge the exhaust gases downwardly from the lowermost edge thereof. The exhaust gases are thus discharged adjacent to the lower bearing support assembly or the lower end of assembly 9 and will be maintained essentially above or at the water line of the outboard motor under idle conditions. The U-shaped passageway 67 is completed by an outer cover 70 which is secured to the bracket cover 56 in the illustrated embodiment of the invention by three longitudinally spaced cap screws 71 which thread into suitable integrally cast bases on the cover between the arms of the U-shaped passageway 67.

The exhaust gases under engine idle operation are allowed to escape into the baffled expansion chamber 65 which attenuates low frequency sounds. The exhaust gases then pass through the U-shaped passageway which is selected of a constant cross section and length to further attenuate the high frequency sounds and thereby minimize the idle exhaust sounds generated under the conventional idle operation. Thus, the invention provides an idle exhaust system employing the basic teaching of the previously identified co-pending application entitled Exhaust Relief Silencing Apparatus for Marine Propulsion Systems.

Thus, the present invention provides an improved isolated mounting of a manually positioned outboard motor while simultaneously providing the highly improved idle exhaust, particularly adapted for outboard motors and the like.

Various modes of carrying out the invention are contemplated as being within the scope of the following claims particularly pointing and distinctly claiming the subject matter which is regarded as the invention.

I claim:

1. In an outboard motor, a powerhead support housing terminating in the lower end in a propeller unit, a mounting assembly adapted to be releasably interconnected to a boat and having a steering means with a tubular support section encircling the support housing for manual rotation, said tubular support section includes upper and lower spaced bearing portions encircling said support housing and having a steering element connected to the upper bearing portion for manual rotation, said upper and lower bearing portions are split with each bearing portion including a semi-circular base and an opposite half of each bearing portion being a separate cover connected to the circular base, said mounting assembly having an outer enclosing swivel tubular section encircling the tubular support section to define an essentially closed chamber, said support housing having an exhaust gas opening means aligned with the semi-circular base, resilient isolating means including upper and lower annular members formed of a rubber-like resilient material and located between the upper and lower bearing portions and the support housing, said annular members including individual connection means to the support section and to the support housing, said isolating means permitting physical transmission of steering forces while maintaining vibration isolation of the powerhead and support housing from the mounting assembly.

2. In the outboard motor of claim 1, a tuning exhaust passageway connected to the swivel tubular section for exhausting of the exhaust gases from said expansion chamber.

3. In an outboard motor having a support housing with an upper powerhead end and a lower propeller end and mounted within a swivel bracket mounting assembly comprising an improved mounting apparatus including a steering assembly having a steering tubular section encircling said support housing, a plurality of longitudinally spaced, resilient coupling and mount members located between said support housing and said tubular section, said resilient mount members including an upper and lower annular members having peripheral slots individually and separately releasably mated with corresponding projections of the support housing and of the tubular section, said lower annular member resting on the support housing and the upper annular member resting on the tubular section with the support housing resting on the upper annular member to resiliently mount the housing on the steering assembly and coupling said housing to the steering assembly for corresponding rotational movement, means rotatably mounting the tubular section within said bracket assembly to permit rotational positioning of the tubular section and the interconnected support housing for steering of the outboard motor while isolating of the support housing and powerhead from the steering assembly tubular section and the bracket assembly.

4. In the outboard motor of claim 3 wherein said projections on said support housing are offset ninety degrees from the projections on said tubular section, said annular members formed of a resilient rubber-like material and each having a first pair of diametrically spaced slots extending axially from one end of the annular member and mating with the projections on the support housing and having a second pair of diametrically spaced slots extending axially from the opposite end of the annular member and mating with the projections on the tubular section.

5. In the outboard motor of claim 3 wherein said tubular section includes a first semi-circular base encircling the support housing and including an upper bearing portion with an internal projection mating with one of the slots in the upper annular member, said semi-circular base having a lower bearing portion including an inward projection mating with one of the slots in the lower annular member, a steering arm projecting outwardly from the base and terminating in a manually grippable handle, an upper semi-circular bearing cover encircling the upper annular member and including a projection mating with a slot of the upper annular member, bolt means connecting the upper cover to the upper bearing portion, a similar lower cover having a projection mating with a slot in the lower annular member, bolt means connecting the lower cover to the lower bearing portion, and a swivel bracket assembly having a split housing forming a swivel tubular section encircling said steering tubular section, the upper end of the steering tubular section being supported upon the upper end of the swivel tubular section.

6. In the outboard motor of claim 5 including sleeve bearings located between the swivel tubular section and the steering tubular section and having outwardly projecting thrust bearings overlying the ends of the swivel tubular section.

7. In the outboard motor of claim 5 wherein said swivel bracket assembly includes a semi-circular base and a semi-circular swivel cover releasably secured to the base and defining said swivel tubular section encircling the steering tubular section of the steering assembly, said steering tubular section having upper and lower ledges aligned with the opposite ends of the swivel tubular section, a sleeve bearing located between the upper end of the swivel tubular section and the steering tubular section and including an upper outwardly extending thrust bearing located between the uppermost end of the swivel tubular section and upper ledge of the steering tubular section, a lower sleeve bearing located between the lower end of the swivel tubular section and the steering tubular section immediately above the lower annular member and having an outwardly extending thrust bearing located between the lowermost end of the swivel tubular section and the lower ledge of the steering tubular section.

8. In the outboard motor of claim 7 wherein said support housing is spaced from the semi-circular base of the steering tubular section to define a chamber including a pair of diametrically located openings defining idle exhaust relief openings for discharging of trapped exhaust gases outwardly into the chamber between the support housing and the semi-circular base of the steering tubular section, said gases passing rearwardly into a chamber defined between the exterior of the housing and the outer swivel cover of the swivel tubular section, said swivel cover having an exhaust opening located immediately above the lower sleeve bearing, an exhaust passageway extension formed in the back wall of the swivel cover and including a U-shaped passageway extending upwardly from said exhaust opening to the upper end portion of the swivel cover and then extending downwardly to the opposite side thereof and terminating in the lowermost end of the swivel cover to discharge the gases downwardly, said passageway having a constant cross-section and a predetermined length to attenuate selected exhaust gas frequencies.

9. The apparatus or outboard motor assembly of claim 7 wherein a co-pilot strap encircles the upper sleeve bearing between the upper end portion of the swivel tubular section and the adjacent steering tubular section, said upper sleeve bearinng having a peripheral slit permitting selective collapsing of the bearing onto the adjacent steering tubular section, and means to adjust the tension of the encircling strap to control the frictional engagement of the bearing with the steering tubular section to thereby vary the friction holding force thereon.

10. In the outboard motor of claim 5 wherein said swivel tubular section is an essentially continuous section enclosing the space between the upper and lower mount members, and defining an exhaust gas expansion chamber, said support housing having an exhaust gas opening to said expansion chamber, and said swivel tubular section including an exhaust gas discharge opening.

11. In the outboard motor of claim 10 having a tuned exhaust gas passageway means secured to the swivel tubular section and having an inlet coupled to said discharge opening, said passageway means being tuned to attenuate selected sound frequencies.

12. In the outboard motor claim 11 wherein said swivel tubular section is a longitudinally split member having a back wall cover, and said tuned exhaust gas passageway means having side walls integrally formed on said cover and including an outer cap releasably secured to close the side walls.

13. In the outboard motor of claim 11 wherein said tuned exhaust gas passageway means is a generally inverted U-shaped passageway of a constant cross-section.

14. A mounting and steering coupling assembly for an outboard motor having a tubular drive shaft and exhaust housing with an upper powerhead mounting section and a depending cylindrical portion connected to a lower portion with a horizontal ledge at the lower end of the cylindrical portion, a powerhead unit connected to the mounting section and including an internal combustion engine rigidly bolted to the upper mounting section of the shaft and exhaust housing, said engine including an exhaust means discharging into said housing, said housing having a pair of exterior upper projections and a pair of exterior lower projections adjacent the upper and lower ends of the cylindrical portion, said upper and lower projections being located to diametrically opposite sides of the cylindrical portion, an upper annular mount member formed of a resilient rubber-like material and having a pair of slots extending axially of the annular member and mating with the upper projections on the housing, said annular member being split to permit assembly of the annular member about the housing with the slots mating with said projections, a corresponding lower annular mount member having slots mating with the lower projections on the housing, said upper and lower mount members each having a second pair of slots offset from the first slots, a steering assembly having a split steering tubular section and including a first semi-circular base encircling the upper mount member concentrically of the cylindrical portion and including an upper bearing portion with an internal projection mating with one of the second slots in the upper mounting member and having a lower bearing ledge, said semi-circular base having a lower bearing portion including an inward projection mating with one of the second slots in the lower mount member, said semi-circular base being spaced from the cylindrical portion to define a chamber therebetween, a steering arm projecting outwardly from the upper bearing portion and terminating in a manually grippable twist handle, an upper semi-circular bearing cover encircling the upper mount member and including a projection mating with the second of the second slots, bolt means connecting the upper cover to the upper bearing portion, and a similar lower bearing cover having a projection mating with the second of the second slots in the lower mount member, bolt means connecting the lower cover to the lower bearing portion, said base and said lower cover defining a thrust bearing ledge, a swivel bracket assembly having a semi-circular base and an outer semi-circular swivel cover releasably secured to the base defining a swivel tubular section encircling the split steering tubular section of the steering assembly, a sleeve bearing located between the upper end of the swivel tubular section and the steering tubular section and including an upper outwardly extending thrust bearing located between the uppermost end of the swivel tubular section and the ledge of the upper bearing portion of the steering tubular section, a lower sleeve bearing located between the lower end of the swivel tubular section and the steering tubular section immediately above the lower annular mount member and having an outwardly extending thrust bearing located between the lowermost end of the swivel tubular section and said thrust bearing ledge of the steering tubular section, said cylindrical portion having a pair of diametrically located openings defining idle exhaust relief openings for discharging of trapped exhaust gases outwardly into the chamber between the semi-circular base of the steering tubular section and the cylindrical portion, said gases passing rearwardly into the chamber defined between the bearing covers and the exterior of the housing and outer swivel cover of the swivel tubular section, said swivel cover having an exhaust opening located immediately above the lower sleeve bearing, an exhaust passageway extension formed in the back wall of the swivel cover and including a U-shaped passageway extending upwardly from said exhaust opening to the upper end portion of the swivel cover and then extending downwardly to the opposite side thereof and terminating in the lowermost end of the cover to discharge the gases downwardly, said passageway having a constant cross-section and a predetermined length to attenuate selected exhaust gas frequencies.

15. The coupling assembly of claim 14 wherein a co-pilot strap encircles the upper sleeve bearing between the upper end portion of the swivel tubular section and the adjacent steering tubular section, said upper sleeve bearing having a peripheral slit permitting selective collasping of the bearing onto the adjacent steering arm tubular section, and means to adjust the tension of the encircling strap to control the frictional engagement of the bearing with the steering tubular section to thereby vary the friction holding force thereon.

16. In an outboard motor having a support housing with a powerhead secured to the upper end thereof and a propeller unit secured to the lower end thereof and mounted within a swivel bracket mounting assembly, said powerhead including an internal combustion engine exhausting gas downwardly through said housing, an improved mounting apparatus comprising a tubular section encircling said support housing, coupling members located between said support housing and said tubular section and defining an exhaust expansion chamber, said support housing having an exhaust opening to said expansion chamber, and a tuned passageway means secured to the tubular section and having an inlet connected to said expansion chamber.

17. In the outboard motor of claim 16 including a tuning member including a semi-circular base located between the housing and the tubular section with said base overlying said exhaust opening, said base being connected to the support housing for steering of the outboard motor and maintaining said base overlying said exhaust opening.

18. The outboard motor of claim 16 wherein said housing includes a pair of diametrically located idle exhaust relief openings with said semi-circular base for discharging of trapped exhaust gases outwardly into the chamber therebetween, said gases passing rearwardly into the chamber defined between the exterior of the housing and the outer tubular section, said tubular section being a split member having an aft cover with said exhaust opening, said tuned passageway formed in the back wall of the cover and including a U-shaped passageway extending upwardly from said exhaust inlet to the upper end portion of the cover and then extending downwardly to the opposite side thereof and terminating in the lowermost end of the cover to discharge the gases downwardly, said passageway having a constant cross-section and a predetermined length to attenuate selected exhaust gas frequencies.

* * * * *

UNITED STATES PATENT AND TRADEMARK OFFICE

CERTIFICATE OF CORRECTION

PATENT NO. : 3,961,595

DATED : June 8, 1976

INVENTOR(S) : JAMES A. MEYER

It is certified that error appears in the above–identified patent and that said Letters Patent are hereby corrected as shown below:

| | | | | |
|---|---|---|---|---|
| Column | 1, | Line | 49, | after "within" insert --- which ---; |
| Column | 3, | Line | 6, | cancel "assmebly" and insert --- assembly ---; |
| Column | 4, | Line | 1, | before "portion" cancel "cylinder" and insert --- cylindrical ---; |
| Column | 9, | Line | 66, | after "motor" insert --- of ---; |
| Column | 12, | Line | 21, | after "openings" cancel "with" and insert --- within ---; |

Signed and Sealed this

Thirty-first Day of August 1976

[SEAL]

*Attest:*

RUTH C. MASON
*Attesting Officer*

C. MARSHALL DANN
*Commissioner of Patents and Trademarks*